US005743346A

United States Patent [19]

Flood et al.

[11] Patent Number: 5,743,346

[45] Date of Patent: Apr. 28, 1998

[54] ABRASIVE CUTTING ELEMENT AND DRILL BIT

[75] Inventors: Gary Martin Flood, Canal Winchester; David Mark Johnson, Westerville; Bradley Earl Williams, Worthington, all of Ohio

[73] Assignee: General Electric Company, Pittsfield, Mass.

[21] Appl. No.: 611,896

[22] Filed: Mar. 6, 1996

[51] Int. Cl.[6] ..... E21B 10/56

[52] U.S. Cl. ..... 175/420.2; 175/432; 407/118

[58] Field of Search ..... 175/420.1, 420.2, 175/428, 430, 432; 407/118, 119

[56] References Cited

U.S. PATENT DOCUMENTS

| | | | |
|---|---|---|---|
| 4,109,237 | 8/1978 | Hill | 382/117 |
| 4,109,737 | 8/1978 | Bovenkerk | 175/430 |
| 4,694,918 | 9/1987 | Hall | 175/430 |
| 4,784,023 | 11/1988 | Dennis | 78/108.2 |
| 4,940,099 | 7/1990 | Deane et al. | 175/374 |
| 4,972,637 | 11/1990 | Dyer | 51/295 |
| 5,007,207 | 4/1991 | Phaal | 451/548 |
| 5,486,137 | 1/1996 | Flood et al. | 175/428 |
| 5,566,779 | 10/1996 | Dennis | 407/118 X |
| 5,575,342 | 11/1996 | Hedlund et al. | 175/420.2 X |

FOREIGN PATENT DOCUMENTS

| | | |
|---|---|---|
| 0 133 386 | 2/1985 | European Pat. Off. . |
| 0 218 959 A2 | 4/1987 | European Pat. Off. . |
| 0 389 800 A1 | 10/1990 | European Pat. Off. . |
| 0 688 937 A1 | 12/1995 | European Pat. Off. . |
| 0 691 167 A1 | 1/1996 | European Pat. Off. . |

*Primary Examiner*—David J. Bagnell

[57] ABSTRACT

An abrasive cutting element comprised of an abrasive cutting layer and a metal substrate wherein the interface therebetween has a tangential chamfer, the plane of which forms an angle of about 5° to about 85° with the plane of the surface of the cylindrical part of the metal substrate. The abrasive cutting layer is preferably diamond or cubic boron nitride and the metal substrate is preferably tungsten carbide.

16 Claims, 2 Drawing Sheets

ABRASIVE CUTTING ELEMENT AND DRILL BIT

FIELD OF THE INVENTION

The present invention relates to the field of abrasive cutting elements and, more particularly, to such cutting elements having an abrasive particle layer outer periphery and a metal substrate wherein the interface therebetween has a tangential chamfer which intersects the radiused portion of the substrate to which the abrasive layer is attached and the cylindrical portion of the substrate.

BACKGROUND OF THE INVENTION

Abrasive compacts are used extensively in cutting, milling, grinding, drilling, and other abrasive operations. The abrasive compacts typically consist of polycrystalline diamond or cubic boron nitride (CBN) particles bonded into a coherent hard conglomerate. The abrasive particle content of the abrasive compact is high and there is an extensive amount of direct particle-to-particle bonding. Abrasive compacts are made under elevated temperature and pressure conditions at which the abrasive particles, be it diamond or cubic boron nitride, are crystallographically stable.

Abrasive compacts tend to be brittle and, in use, they are frequently supported by being bonded to a cemented metal substrate such as a carbide substrate. Such supported abrasive compacts are known in the art as composite abrasive compacts. Composite abrasive compacts may be used as such in the working surface of an abrasive tool. Alternatively, particularly in drilling and mining operations, it has been found advantageous to bond the composite abrasive compact to an elongated cemented carbide pin to produce what is known as a stud cutter. The stud cutter then is mounted, for example, in the working surface of a drill bit or a mining pick.

Fabrication of the composite compact typically is achieved by placing a cemented carbide substrate into the container of a press. A mixture of diamond grains or diamond grains and catalyst binder is placed atop the substrate and compressed under high pressure and high temperature (HP/HT) conditions. In so doing, metal binder migrates from the substrate and "sweeps" through the diamond grains to promote a sintering of the diamond grains. As a result, the diamond grains become bonded to each other to form a diamond layer which concomitantly is bonded to the substrate along a conventionally planar interface. Metal binder remains disposed in the diamond layer within pores defined between the diamond grains.

A composite compact formed in the above-described manner may be subject to a number of shortcomings. For example, the coefficients of thermal expansion and elastic constants of cemented carbide and diamond are close but not exactly the same. Thus, during heating or cooling of the polycrystalline diamond compact (PDC), thermally induced stresses occur at the interface between the diamond layer and the cemented carbide substrate, the magnitude of these stresses being dependent, for example, on the disparity in thermal expansion coefficients and elastic constants.

Another potential shortcoming which should be considered relates to the creation of internal stresses within the diamond layer which can result in a fracturing of that layer. Such stresses also result from the presence of the cemented carbide substrate and are distributed according to the size, geometry, and physical properties of the cemented carbide substrate and the polycrystalline diamond layer.

European Patent Application No. 0133 386 suggests a PDC in which the polycrystalline diamond body is completely free of metal binder and is to be mounted directly on a metal support. However, the mounting of a diamond body directly on metal presents significant problems relating to the inability of the metal to provide sufficient support for the diamond body. This European Patent Application further suggests the use of spaced ribs on the bottom surface of the diamond layer which are to be embedded in the metal support.

According to this European Patent Application, the irregularities can be formed in the diamond body after the diamond body has been formed, e.g., by laser or electronic discharge treatment, or during the formation of the diamond body in a press, e.g., by the use of a mold having irregularities. As regards the latter, it is further suggested that a suitable mold could be formed of cemented carbide; in such case, however, metal binder would migrate from the mold and into the diamond body, contrary to the stated goal of providing a metal free diamond layer. The reference proposes to mitigate this problem by immersing the thus-formed diamond/carbide composite in an acid bath which would dissolve the carbide mold and leach all metal binder from the diamond body. There would thus result a diamond body containing no metal binder and which would be mounted directly on a metal support. Notwithstanding any advantages which may result from such a structure, significant disadvantages still remain, as explained below.

In sum, this European Patent Application proposes to eliminate the problems associated with the presence of a cemented carbide substrate and the presence of metal binder in the diamond layer by completely eliminating the cemented carbide substrate and the metal binder. However, even though the absence of metal binder renders the diamond layer more thermally stable, it also renders the diamond layer less impact resistant. That is, the diamond layer is more likely to be chipped by hard impacts, a characteristic which presents serious problems during the drilling of hard substances such as rock.

It will also be appreciated that the direct mounting of a diamond body on a metal support will not, in itself, alleviate the previously noted problem involving the creation of stresses at the interface between the diamond and metal, which problem results from the very large disparity in the coefficients of thermal expansion between diamond and metal. For example, the thermal expansion coefficient of diamond is about $45\times10^{-7}$ cm/cm/°C. as compared to the coefficient of $150–200\times10^{-7}$ cm/cm/°C. for steel. Thus, very substantial thermal induced stresses will occur at the interface. In addition, once the portions of the diamond which do not carry the ribs begin to wear sufficiently to expose the metal therebehind, that metal will wear rapidly, due to its relative ductility and lower abrasion/erosion resistance, which metal wear would undermine the integrity of the bond between the diamond and the metal support.

Recently, various PDC structures have been proposed in which the diamond/carbide interface contains a number of ridges, grooves, or other indentations aimed at reducing the susceptibility of the diamond/carbide interface to mechanical and thermal stresses. In U.S. Pat. No. 4,784,023, a PDC includes an interface having a number of alternating grooves and ridges, the top and bottom of which are substantially parallel with the compact surface and the sides of which are substantially perpendicular to the compact surface.

U.S. Pat. No. 4,972,637 provides a PDC having an interface containing discrete, spaced-apart recesses extending into the cemented carbide layer, the recesses containing abrasive material (e.g., diamond) and being arranged in a series of rows, each recess being staggered relative to its nearest neighbor in a adjacent row. It is asserted in the '637 patent that as wear reaches the diamond/carbide interface, the recesses, filled with diamond, wear less rapidly than the cemented carbide and act, in effect, as cutting ridges or projections. When the PDC is mounted on a stud cutter, as shown in FIG. 5 of the '637 patent, wear plane 38 exposes carbide regions 42 which wear more rapidly than the diamond material in the recesses 18. As a consequence, depressions develop in these regions between the diamond filled recesses. The '637 patent asserts that these depressed regions, which expose additional edges of diamond material, enhance the cutting action of the PDC.

U.S. Pat. No. 5,007,207 present an alternative PDC structure having a number of recesses in the carbide layer, each filled with diamond, which recesses are formed into a spiral or concentric circular pattern (looking down at the disc shaped compact). Thus, the '207 structure differs from the '637 structure in that, rather than employing a large number of discrete recesses, the '207 structure uses one or a few elongated recesses which form a spiral or concentric circular pattern. FIG. 5 in the '207 patent shows the wear plane which develops when the PDC is mounted and used on a stud cutter. As with the '637 structure, the wear process creates depressions in the carbide material between the diamond filled recesses in the '207 structure. Like the '207 patent, the '637 patent also asserts that these depressions, which develop during the wear process, enhance cutting action.

Whereas the aforementioned patents assert a desirable cutting action in the rock, it is also highly desirable to minimize the diamond layers susceptibility to fracture and spall which in part arises from the internal residual stresses.

SUMMARY OF THE INVENTION

This invention is directed to an abrasive cutting element having a particular interfacial configuration between the abrasive particle outer layer and the metal substrate to which it is bonded. One of the problems associated with polycrystalline diamond cutting elements, for example, is the stress distribution on the cutting element. That is, the cutting element tends to fail at the location of the highest stresses. However, these stresses can be changed by the design of the abrasive cutting element. While the outer abrasive cutting surface of the cutting element of this invention is described in terms of a polycrystalline diamond layer or compact, cubic boron nitride or wurtzite boron nitride or combination of any of these super hard abrasive materials is also applicable for the cutting surface or plane of the abrasive cutting element.

While PDC is the material often referred to in the literature and in this application has a metal substrate, the metal substrate may be cemented or sintered metal carbide of one of the Group IVB, VB and VIB metals which are generally pressed or sintered in the presence of a binder of cobalt, nickel, or iron or the alloys thereof.

The outer surface of the cutting element herein forms a cutting surface. The interface between the cutting element surface and the metal substrate to which the cutting element layer is bonded has a tangential chamfer which intersects the radiused portion of the substrate and the cylindrical portion of the substrate or simply to chamfer angle. The metal substrate is sometimes referred to as a stud. The outer periphery of the cutting element is conical or hemispherical. The improved interface configuration of this invention provides a cutting element having improved (a) residual stress, (2) resistance to delamination, (3) resistance to impact failure and (4) resistance to failure by compressive loading. The substrate or stud is preferably tungsten carbide.

The angle of the tangential chamfer or chamfer angle can vary from about 5° to about 85° and is preferably about 30° to about 75° More specifically, the preferred angle is about 40° to about 55° As will be seen in the drawings, this is angle $\phi$. The configuration of the balance or remaining part of the interface is essentially hemispherical, conical or planar.

Also included in this invention, is an improved drill bit comprising a shaft and a cutting element holder containing a plurality of exposed abrasive cutting elements therein. The type of drill bit may be either a drag drill bit or a rotary drill bit. The rotary drill bit is described in U.S. Pat. No. 4,109,237 which patent is incorporated herein by reference.

DESCRIPTION OF THE DRAWING

Figure 1:
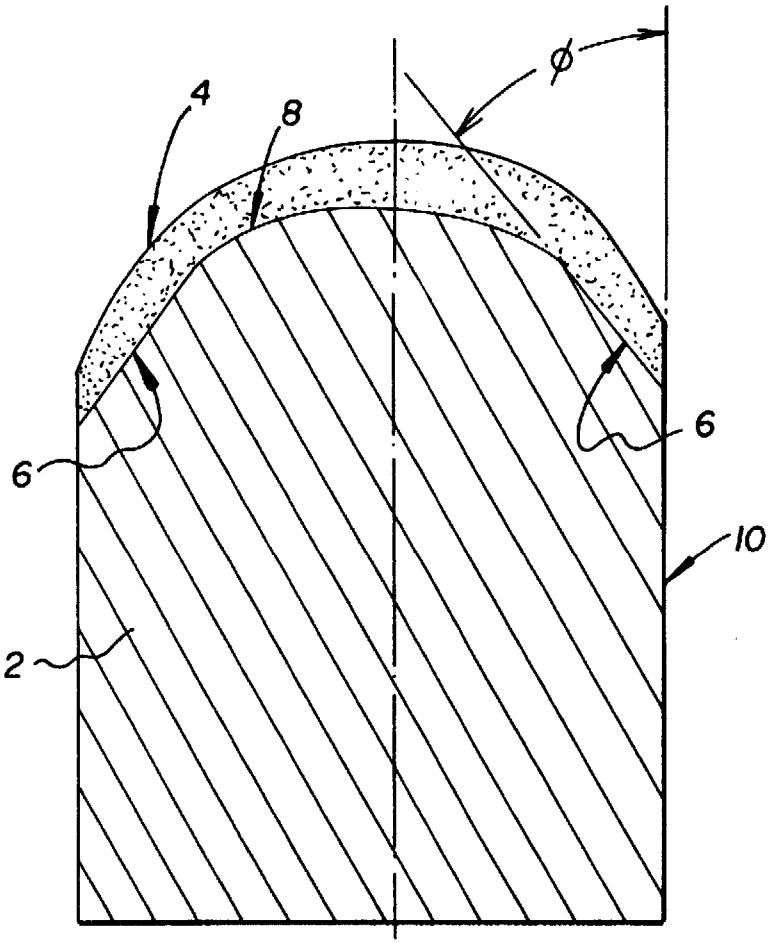
FIG. 1 is a cross sectional view of one embodiment of the abrasive cutting element of this invention.

FIG. 1 is a cross sectional view of one embodiment of the abrasive cutting element of this invention comprising metal substrate (stud) 2, abrasive cutting periphery 4, tangential chamfer 6 and conical interface 8. Angle $\phi$ is the angle between the plane of chamfer 6 and the plane of cylindrical surface 10 of substrate 2. The substrate 2 is comprised of cemented metal carbide, preferably tungsten carbide, and the abrasive cutting layer 4 is comprised of abrasive particles integrally bonded to substrate 2. Cutting layer 4 is preferably polycrystalline diamond, but may be any of the other super hard abrasives, such as cubic boron nitride, etc.

Figure 2:
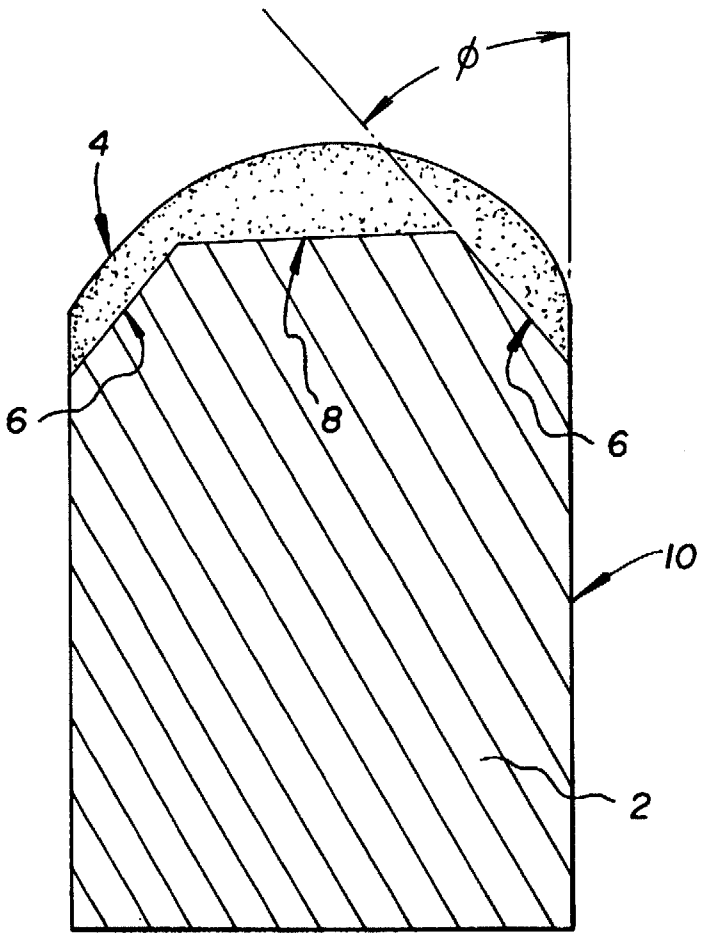
FIG. 2 is a cross sectional view of another embodiment of a cutting element of this invention.

FIG. 2 is a cross sectional view of another embodiment of this invention comprising metal substrate (stud) 2, abrasive cutting periphery 4, tangential chamfer 6 and planar surface 8. Angle $\phi$ is the angle between the plane of chamfer 6 and the plane of cylindrical surface 10 of substrate 2.

Figure 3:
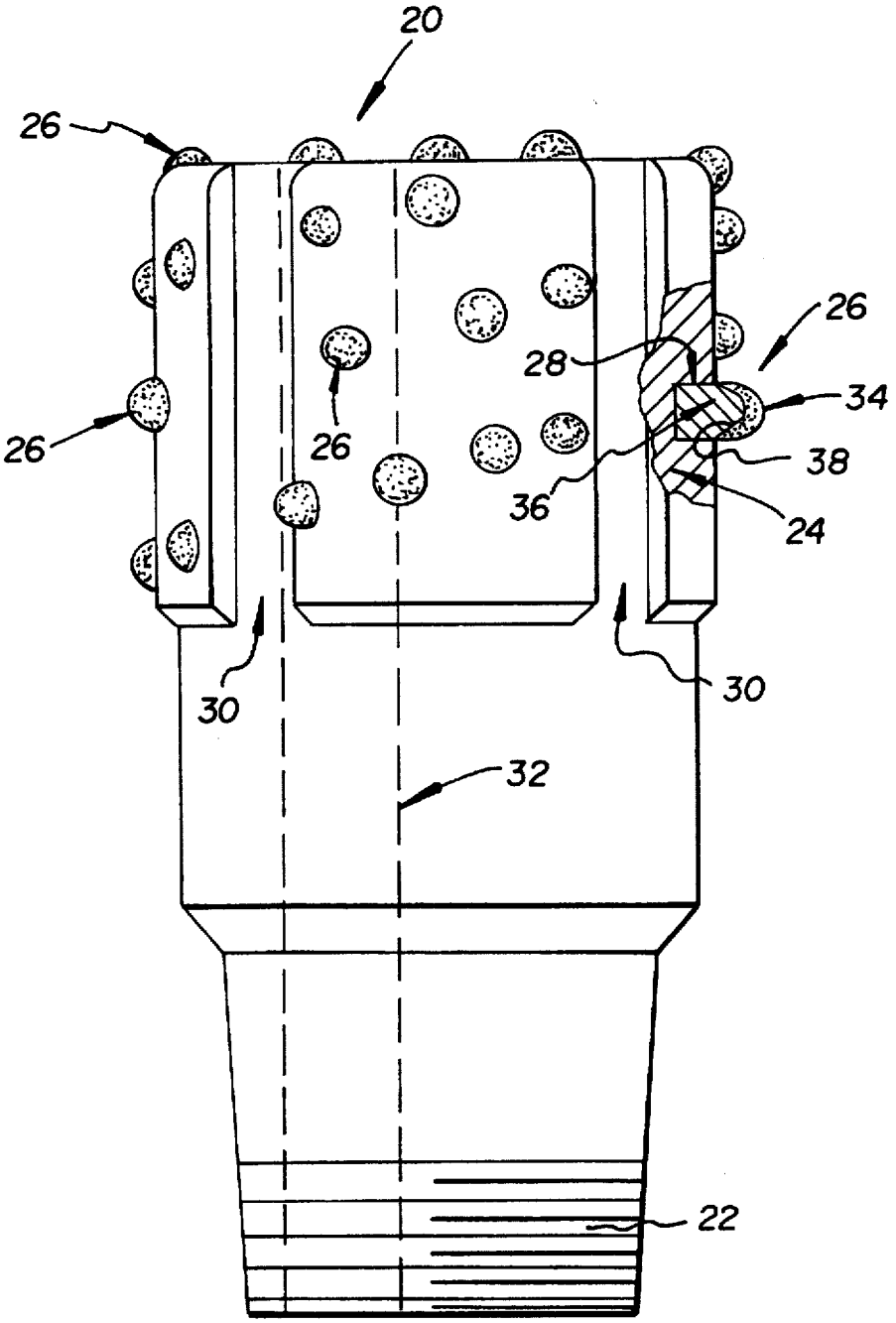
FIG. 3 is an illustration of an improved drill bit with a plurality of abrasive cutting elements mounted therein, and with a magnified sectional view of one cutting element.

FIG. 3 illustrates the improved drill bit of this invention with a plurality of abrasive cutting elements of this invention mounted therein. Bit 20 is comprised of shaft 22 and a drill crown 24 in which a plurality of cutting elements 26 are mounted in recesses 28. Water ways 30 are conventionally designed water ways and fluid port 32 is provided longitudinally in the drill body. A sectional view of one cutting element 26 (magnified) illustrates the interface between abrasive layer 34 and metal substrate 36 with tangential chamfer 38.

It will thus be seen that the objects of this invention, as set forth above, among those made apparent from the preceding description are efficiently attained, and since certain changes may be made in carrying out the above invention, it is to be understood that the invention is not limited to the precise form. Changes and modifications may be made thereon without departing from the scope and spirit of the invention as defined in the appended claims.

What is claimed is:

1. An abrasive cutting element consisting essentially of a hemispherical abrasive layer and a metal substrate having a center and a cylindrical outer surface, said abrasive layer is exposed when inserted into a holder, and wherein said abrasive layer consists essentially of an outer surface and an inner surface, which inner surface is bonded to the metal substrate thereby defining an interface therebetween, said interface has a tangential chamfer which slopes away from the center of the metal substrate such that a plane of the slope of the tangential chamfer forms an angle of about 5° to about 85° with a vertical plane of the cylindrical surface of the metal substrate, and further, said interface has a central position which is other than the tangential chamfer.

2. The abrasive cutting element of claim 1 wherein the remainder of the interface other than the tangential chamfer is essentially conical.

3. The abrasive cutting element of claim 1 wherein the remainder of the interface other than the tangential chamfer is essentially planar.

4. The cutting element of claim 1 wherein the abrasive cutting layer is comprised of polycrystalline diamond.

5. The cutting element of claim 1 wherein the abrasive cutting element is comprised of cubic boron nitride.

6. The cutting element of claim 1 wherein the metal substrate of the cutting element is selected from the group consisting essentially of Group IVB, Group VB, and Group VIB metal carbide.

7. The cutting element of claim 1 wherein the metal substrate is tungsten carbide.

8. The cutting element of claim 1 wherein the angle of the tangential chamfer is about 30° to about 75°.

9. The cutting element of claim 1 wherein the angle of the tangential chamfer is about 40° to about 55°.

10. An improved drill bit comprising a shaft, a crown at one end of said shaft and containing a plurality of exposed abrasive cutting elements which cutting element is the cutting element of claim 1.

11. The improved drill bit of claim 10 wherein the abrasive cutting layer is comprised of polycrystalline diamond.

12. The improved drill bit of claim 10 wherein the abrasive cutting layer is comprised of cubic boron nitride.

13. The improved drill bit of claim 10 wherein the metal substrate of the cutting element is selected from the group consisting essentially of Group IVB, Group VB and Group VIB metal carbide.

14. The improved drill bit of claim 13 wherein the metal substrate of the cutting element is tungsten carbide.

15. The improved drill bit of claim 10 wherein the drill bit is a rotary drill bit.

16. The improved drill bit of claim 10 wherein the drill bit is a drag drill bit.

* * * * *